US006695512B1

(12) United States Patent
Sutherland

(10) Patent No.: US 6,695,512 B1
(45) Date of Patent: Feb. 24, 2004

(54) WRITING IMPLEMENT WITH MOVABLE SLEEVE

(76) Inventor: Chad C. Sutherland, 5560 Juel Gill Rd., Myakka, FL (US) 34251

( * ) Notice: Subject to any disclaimer, the term of this patent is extended or adjusted under 35 U.S.C. 154(b) by 0 days.

(21) Appl. No.: 10/430,532

(22) Filed: May 6, 2003

(51) Int. Cl.[7] ..... B43K 7/12

(52) U.S. Cl. ..... 401/117; 401/55; 401/81; 401/107

(58) Field of Search ..... 401/6, 53, 55, 401/62, 80–84, 87, 95, 99, 107, 109, 114, 115, 117

(56) References Cited

U.S. PATENT DOCUMENTS

| | | | | | |
|---|---|---|---|---|---|
| 2,435,185 | A | * | 1/1948 | Reynolds | 401/117 |
| 2,941,511 | A | * | 6/1960 | Cieremans | 401/107 |
| 3,741,665 | A | * | 6/1973 | Smagala-Romanoff | 401/117 |
| 4,778,300 | A | * | 10/1988 | French et al. | 401/55 |
| 6,273,627 | B1 | * | 8/2001 | Mittersinker et al. | 401/117 |
| 6,530,709 | B1 | * | 3/2003 | Washington | 401/117 |
| 6,568,866 | B1 | * | 5/2003 | Hsu | 401/117 |
| 6,607,324 | B2 | * | 8/2003 | Choi | 401/55 |

FOREIGN PATENT DOCUMENTS

| | | | | |
|---|---|---|---|---|
| DE | 3841746 | A1 | * 6/1990 | B43K/5/16 |

* cited by examiner

*Primary Examiner*—Tuan N. Nguyen
(74) *Attorney, Agent, or Firm*—Dorothy S. Morse

(57) ABSTRACT

A writing implement with a movable sleeve that can be raised by light finger pressure and automatically or manually lowered into a protective position between writing uses. Alternative means can be used to raise and lower the sleeve, such as but not limited to a push bar, roll ball, lever, sliding mechanism, or depressible button. A stop disk prevent the sleeve from being fully withdrawn from the writing implement housing and a locking mechanism between the housing and the sleeve prevents casual contact from prematurely releasing the sleeve from its protective position. Optionally, braces can be used to stabilize the marking material cartridge, a sleeve insert can be used to prevent the writing tip from drying out, and a swivel clip with a high friction grip can be employed to securely position the writing implement between uses. Applications can include use with pens, pencils, markers, paint markers, crayons, and highlighters.

20 Claims, 5 Drawing Sheets

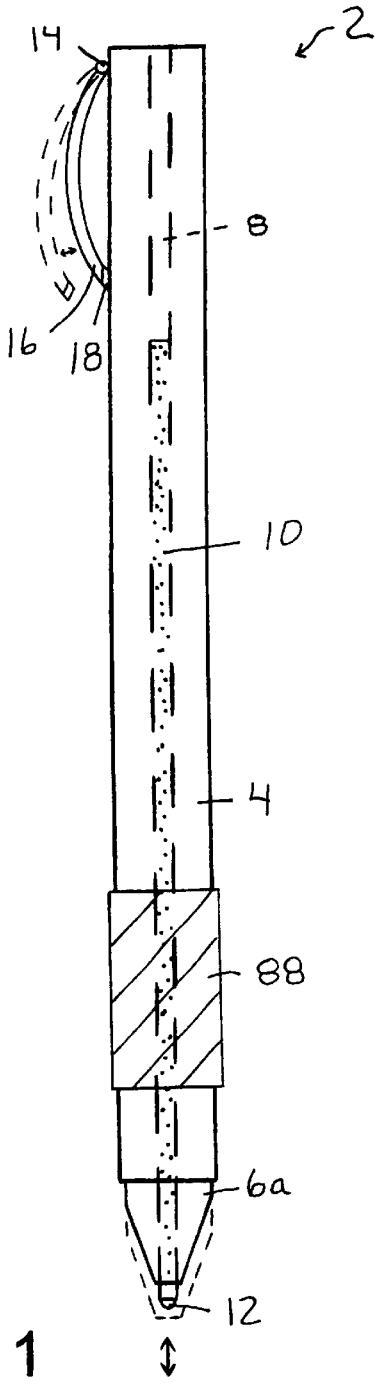
Fig. 1
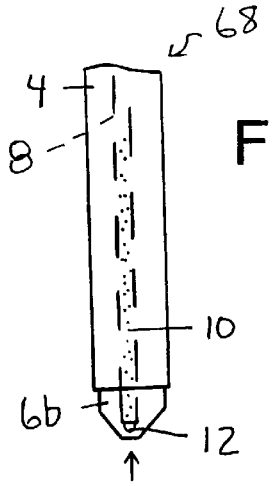
Fig. 2
Fig. 3
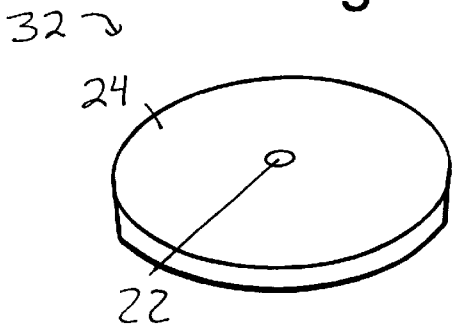
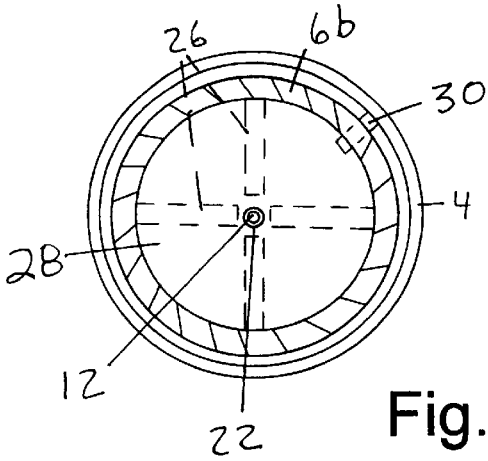
Fig. 4

WRITING IMPLEMENT WITH MOVABLE SLEEVE

CROSS-REFERENCES TO RELATED APPLICATIONS

None.

BACKGROUND OF THE INVENTION—FIELD OF THE INVENTION

This invention relates to the field of pens and other writing implements, specifically to a writing implement having a sleeve that covers and protects the writing tip of the implement when it is not in use to keep any marking material remaining on the writing tip from subsequently coming into contact with the fabric of a clothing pocket into which the writing implement might be stored, or preventing the tip from marking skin, clothing, furniture, rugs, and/or other objects should the writing implement be inadvertently dropped. A writer can easily use his or her finger or thumb with lightly applied pressure against an activating mechanism to move the sleeve into its raised position, and then after writing implement use release the activating mechanism to move the sleeve a short distance into its lowered and protective position covering the writing tip. The activating mechanism used to raise and lower the sleeve can vary. Further, a locking mechanism is used to prevent the sleeve from being inadvertently raised out of its protective position at any time the writing tip is not being used, particularly when the present invention is inserted into a clothing pocket, or in positioned where it can easily fall onto clothing, skin, furniture, rugs and carpeting, and the like. In the most preferred embodiments, a light finger pressure lifting action is all that is needed to maintain the sleeve in its raised position, and when writing stops, release of the finger causes the sleeve to be lowered into its protective position. Optionally, although not preferred, the lowering of the sleeve can also be manually activated. Optionally also, braces may be used to assist in keeping the writing tip centrally located within the writing implement and in a stable position during use, cushioning material can be added to any activating mechanism or to the housing to enhance user comfort, and an insert can be used within the sleeves associated with markers and highlighters to substantially close off the open end of the sleeve when it is in its lowered and protective position around the marking tip to keep the marking tip from drying out. Applications can include, but are not limited to, use with ink pens, pencils, markers, paint markers, crayons, and highlighters.

BACKGROUND OF THE INVENTION—DESCRIPTION OF THE RELATED ART

Writing implements by design need to have a marking material flow out of a tip onto surfaces needing decoration and other markings. Also, users ideally like the marking capability of a writing implement to be immediate, however, where inks and paint are used, the flow of ink or paint should not be incessant. To balance such opposing needs, some readily transferable ink or paint often remains on the tip of a pen or marker after use to assist in a prompt marking capability during subsequent uses. The user is then protected from accidental marking of self and other surfaces by a replaceable cap that covers a writing implement tip when it is not in use, or a means of withdrawing the marking tip into the main housing of the writing implement between uses. Caps are helpful when used, however, people often forget to replace a cap, and even though caps are often designed to fit over the opposing end of the writing implement for temporary storage until needed again to cover the writing tip, they are frequently lost or misplaced. Push-button activated and twist-activated retractable tips also protect users from accidental writing implement marking, but again, use is voluntary, and users often forget to retract the tip after use making it a frequent occurrence for pens or pencils with retractable tips to be thoughtlessly placed into a pocket, such as a shirt pocket, without tip retraction, which then results in stains that are unsightly, as well as time consuming, difficult, and/or expensive to clean. Writing implements are also known wherein the writing tip is caused to automatically retract during the act of securing it to a pocket or other thinly dimensioned vertical support surface, such as the upstanding divider in a briefcase or purse. While such writing implements work well enough for this limited application, writing tip retraction does not automatically occur when the implement is inadvertently dropped or is carelessly allowed to fall onto clothing, skin, carpeting, furniture, and the like where difficult-to-remove marks can be made. Pocket liners made from fluid-resistant materials do exist, and are used by some to protect pockets from writing implement stains, however, liners are inconvenient to use and have never gained widespread acceptance. In contrast, the present invention provides a sleeve that is permanently attached to a writing implement so that it cannot be lost, and it is preferably raised with light finger action as the user picks up the writing implement and places it in a position ready to write, with the sleeve being lowered into its protective position as soon as the light finger pressure is released, without thinking. Further, a locking mechanism maintains the sleeve over the writing tip until the user deliberately releases it. Optionally, a swivel clip with a high-friction distal end can assist in securely positioning the writing implement to which it is attached within a clothing pocket, and cushioning material can be used in many different places on the present invention to enhance user comfort. Braces can also be used to stabilize the writing tip and/or an insert secured within the sleeve to prevent the writing/marking tip from drying out, as needed. There is no writing implement known that has the same features and all of its advantages provided by the present invention.

BRIEF SUMMARY OF THE INVENTION—OBJECTIVES AND ADVANTAGES

The primary object of this invention is to provide a writing implement with a means of protecting its writing or marking tip that prevents unintentional marking by the tip between uses. It is also an object of this invention to provide a means of protecting the writing or marking tip of a writing implement that can be automatically engaged immediately after use. A further object of this invention is to provide a means of protecting the writing or marking tip of a writing implement between uses that is not in conflict with the normal manner of writing implement use with which users are familiar. It is a further object of this invention to provide a means of protecting the writing or marking tip of a writing implement between uses that does not adversely affect the comfort of the hand holding it during use. It is also an object of this invention to provide a writing implement with a sleeve for writing or marking tip protection that further includes improved attachment means for vertical storage of the writing implement between uses, such as in a shirt pocket. It is a further object of this invention to provide an insert within the sleeve of the writing implement when its writing or marking tip is at risk of drying out between uses.

As described herein, properly manufactured and used, the present invention is a writing implement having a longitudinally extendable sleeve configured to protect its writing tip so that marking material remaining on the writing tip between uses is not able to inadvertently become transferred to clothing, skin, and other nearby objects once the writing tip becomes inactive. The configuration of the sleeve is generally cylindrical and it is configured to fit closely within the writing implement housing so that a locking mechanism can be engaged therebetween it and the housing to prevent the sleeve from being prematurely raised by casual contact. The sleeve also has a lip, ridge, flare, or flange on one of its ends that is configured for engagement with one or more stop blocks, ridge, ledge, shelf, or protrusion fixed within the inside surface of the writing implement, the location of which defines the sleeve's fully lowered position and prevents a user from being able to withdraw the sleeve from the writing implement housing. The writing tip end of the sleeve has a tapering configuration. Both ends of the sleeve have a central opening therethrough that is slightly larger in diameter than that of the sealed unit or cartridge containing the writing implement's marking material, which is longitudinally positioned within the writing implement housing, so that the sealed unit or cartridge can extend centrally through the sleeve without interfering with sleeve movement between its raised position that allows for writing tip use and its lowered position protecting the writing tip from unintentional marking of nearby surfaces and objects. Although not limited thereto, the sleeve is preferably no larger than two inches in length, and most often less than one-and-one-half inches in length. Also, the distance moved by the sleeve between its lowered and raised positions is small, preferably a distance between approximately one-fourth of an inch and approximately three-eighths of an inch. A spring positioned around the marking material's sealed unit or cartridge, between the larger end of the sleeve and a stop disk centrally fixed within the writing implement housing, is the preferred means of biasing the sleeve into its protective position. Several means can be used to engage the operant end of the lifting mechanism employed to raise the sleeve from its protective position, such as but not limited to a push bar, depressible button, a lever set within a groove, a sliding release mechanism, and a roll ball that can alternatively be rolled in upward or downward directions, as needed. While automatic lowering of the sleeve into its protective position is preferred, it may also be manually lowered. Further, optional braces can be made to inwardly depend from the sleeve and extend close to the sealed unit or cartridge containing the marking material to stabilize it and the writing or marking tip attached to it. Although a set of four equally spaced-apart braces is contemplated, as well as the use of a second set of braces positioned adjacent to or off-set therefrom, other numbers and configurations of braces are also considered to be within the scope of the present invention. In addition, an optional swivel clip with high friction material on its distal end can be connected to the end of the writing implement housing opposed to its writing tip, for use in securely suspending the writing implement in locations places where its writing tip and/or the sleeve can avoid contact with adjacent surfaces, such as the fabric of a clothing pocket or the material used in a purse or briefcase divider. Further, when the writing or marking tip is at risk for drying out between uses, an insert can be placed within the sleeve close to its lower end to substantially seal it. Although not limited thereto, the insert can be stretchable and made from materials such as a very thin plastic, rubber, latex, or gel, or in the alternative the insert can be in the form of a rigid cover or trap door made from plastic or metal that can optionally be moved into its usable position by an extension member or other means. When the insert is directly secured within the sleeve to the inside sleeve surface, material such as but not limited to adhesives, bonding agents, and/or small fastening projections on the inside surface of the sleeve can be used for insert/sleeve connection. Thus, the sleeve in the most preferred embodiment of the present invention writing implement can be raised with light finger pressure, and then automatically becomes lowered upon release of that finger pressure to prevent any marking by the tip on any nearby surface or object until the sleeve is again raised. The light finger pressure needed to raise the sleeve can be applied by the index finger or thumb, and does not interfere with the normal manner of writing implement use or hand comfort. Raising of the sleeve can also be used to activate the appearance of an object or character familiar to children beyond the housing or via a window or screen. Further, when the object 'pops up', a battery within the writing implement housing can provide motion for the object, lighting, and/or related sounds, or the appearance of related information, or other images or designs, being visibly displayed through a window or screen. There is no writing implement known to have all of the same features and advantages provided by the present invention.

While the description herein provides preferred embodiments of the present invention writing implement, it should not be used to limit its scope. For example, other variations of the present invention, while not shown and described herein, can also be considered within the scope of the present invention, such as variations in the thickness dimension and type of material used to make the sleeve; the configuration of the sleeve; the type of material from which the lifting rod and pivoting extensions are made; the manner in which the lifting rod is attached to the sleeve; the configuration and positioning of the locking mechanism; the thickness of the stop disk and the type of material from which it is made; the number of braces used to stabilize the sealed unit or cartridge containing the marking material and its attached writing or marking tip; the length of the spring used to bias the sleeve into its lowered position; the configuration of the roll ball, when used, and material from which it is made. Thus, the scope of the present invention should be determined by the appended claims and their legal equivalents, rather than being limited to the examples given.

BRIEF DESCRIPTION OF THE SEVERAL VIEWS OF THE DRAWINGS

FIG. 1 is a side view of a first preferred embodiment of the present invention writing implement having a housing with a writing tip that extends beyond one of its opposing ends, a marking material cartridge that extends rearwardly from the writing tip and through the housing, and flexible cushioning material attached to the outside surface of the housing near to its writing tip end, the housing also having an elongated sleeve extending through its writing tip end and which is positioned concentrically between the housing and the writing tip, with the sleeve formed from solid lines indicating a position of full sleeve retraction and broken lines indicating a protective position of full sleeve extension wherein the writing tip is completely covered by the sleeve, and the housing further having a swivel clip on its opposing end remote from the writing tip, with solid lines indicating the swivel clip in its closed position wherein the high-friction material on its distal end is in contact with the outside surface of the housing and broken lines indicating the swivel clip in an open position that allows fast and secure attachment of the housing to a thin and substantially vertically extending support surface, with two double-headed arrows showing the direction of movement of the sleeve and the clip, while the external means of raising and lowering the sleeve remains hidden from view.

FIG. 2 is a side view of a second preferred embodiment of the present invention writing implement having a sleeve with a shortened tapering end that is in its fully extended and protective position covering the writing tip, with an upwardly directed arrow showing the direction of sleeve movement needed to reveal the writing tip for use.

FIG. 3 is a perspective view of a stop disk used in the most preferred embodiments of the present invention in combination with a spring to bias the sleeve into its extended position covering the writing tip that prevents marking material on the writing tip from having direct contact with any nearby surface or object until the sleeve is retracted.

FIG. 4 is an bottom end view of a third preferred embodiment of the present invention sleeve that is also shown in FIG. 10, with the sleeve concentrically positioned within the writing implement housing, a locking mechanism engaged between the sleeve and the writing implement housing to prevent retraction of the sleeve, the sleeve having a tapering surface with a central opening therethrough, a writing tip exposed through the central sleeve opening, and four braces shown in broken lines that extend from the interior surface of the sleeve inwardly toward the marking material cartridge that is attached rearwardly to the writing tip, but hidden from view in this illustration.

DETAILED DESCRIPTION OF THE INVENTION

Figure 5:
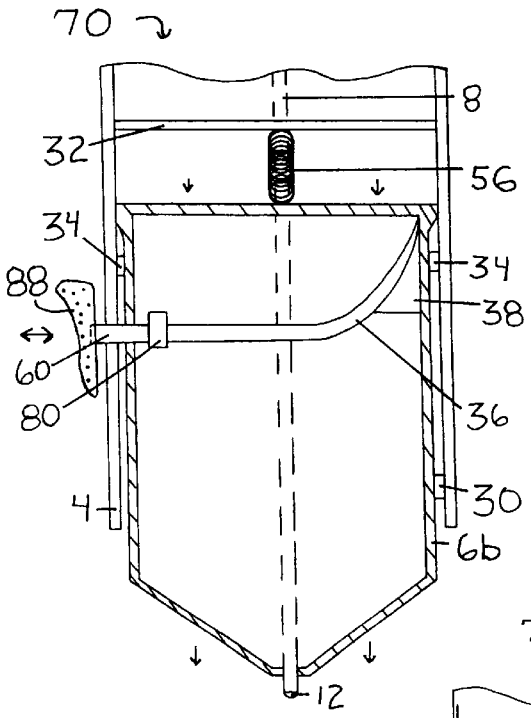
FIG. 5 is a sectional side view of a fourth preferred embodiment of the present invention having a depressible button to raise and lower its sleeve, the button attached to one end of a lifting rod with the other end of the lifting rod being secured to a ramp depending inwardly from the interior sleeve surface, the button shown being substantially depressed, with its distal end close to the outer surface of the housing, and the sleeve raised to reveal a centrally positioned writing tip, a stop bar being attached to the lifting rod within the sleeve to limit the maximum outward movement of the depressible button beyond the housing, the stop bar being shown at a spaced apart distance from the inside sleeve wall, cushioning material secured over the distal portion of the depressible button, a horizontally extending arrow near the button showing the anticipated directions of button movement as the sleeve is raised and lowered, and also with a compressed spring between a stop disk positioned above the sleeve and the top outside surface of the sleeve so that it remains ready to bias the sleeve back into its lowered and protective position around the writing tip once the depressible button is released, the sleeve also having a flared upper end configured to engage a stop ridge, ledge, protrusion, shelf, or block that prevents the sleeve from being withdrawn from the writing implement housing, with a locking mechanism between the housing and the sleeve in an unengaged position and four downwardly extending arrows showing the direction of movement of the sleeve as it would travel toward its protective position.

FIG. 1 shows a first preferred embodiment 2 of the present invention having an elongated and substantially cylindrical housing 4 with opposing ends. The elongated and cylindrical configuration of housing 4 is not critical and in the alternative a housing 4 having shorter lengths and/or other cross-sectional configurations may be substituted, such as but not limited to that of a hexagon, pentagon, octagon, ellipse, or other configuration that a user would find comfortable to hold in a hand for an extended period of time. FIG. 1 further shows marking material cartridge 8 extending centrally and longitudinally within housing 4, with marking material 10 substantially filling cartridge 8 and a writing tip 12 attached to the lower end of cartridge 8. Cartridge 8 is marked in broken lines since it is hidden within housing 4. Extending through the lower end of housing 4 is a sleeve 6*a*, which covers most of the portion of cartridge 8 not protected by housing 4. Solid lines show sleeve 6*a* in a retracted position that makes writing tip 12 available for use. In contrast, broken lines show sleeve 6*a* in a lowered and protective position around writing tip 12 which prevents writing tip 12 from contacting with any surface or object (not shown) until sleeve 6*a* is again raised. A vertically-extending double-headed arrow shows the direction of movement for sleeve 6*a* between its fully retracted and fully extended positions. The increment of longitudinal movement for sleeve 6*a* between its fully retracted and fully extended positions is not great, and although not limited thereto it is contemplated in most preferred embodiments for the distance to be approximately one-fourth to approximately three-eighths of an inch. FIG. 1 shows sleeve 6*a* having a diameter dimension nearly as great as the diameter dimension of housing 4, with the proximal end of sleeve 6*a* positioned within the lower end of housing 4. Other illustrations herein will show preferred means for activating the raising of sleeve 6*a* from its protective position, means for locking sleeve 6*a* into a fixed position against housing 4 so that sleeve 6*a* cannot be moved from its protective position covering writing tip 12 until intentionally released, means for biasing sleeve 6*a* into its lowered and protective position immediately after finger pressure is release from the activating means, insert configurations that would keep the writing/marking tip 12 or 66 (as shown in FIG. 19) from drying out between uses, and means for preventing sleeve 6*a* from being totally withdrawn from housing 4. FIG. 1 further shows optional cushioning material 88 secured around the lower end of housing 4, near to sleeve 6*a*. It is contemplated for cushioning material 88 to be made from flexible material, such as but not limited to rubber, silicone, latex, and/or other soft material that would enhance the comfort of a user's hand (not shown) while it holds housing 4 for extended periods of time. The length and thickness dimensions of cushioning material 88 can be different from that shown in FIG. 1. The shading used for cushioning material 88 in FIG. 1 consists of diagonal lines, to differentiate it from marking material 10 in cartridge 8, which is distinguished from other components in FIG. 1 by dots or specks. However, the remaining illustrations that show cushioning material 88, distinguish it via the use of a plurality of dots or specks, simply as a matter of artistic rendering. In addition, FIG. 1 shows a swivel clip 16 pivotally connected to the outside surface of housing 4 at its upper end via hinge/pin 14. Although such use is not shown, it is contemplated for swivel clip 16 to be employed in securely attaching housing 4 to a support surface or object for temporary storage, such as but not limited to shirt pocket fabric, a briefcase divider, a book cover, or a binder ring. Solid lines show swivel clip 16 in its locked position with the high-friction material 18 on its distal end in contact with housing 4. In contrast, broken lines show swivel clip 16 in its open position with high-friction material 18 at a spaced-apart distance from housing 4. Although not shown, a button on the top of swivel clip 16 can be used to move swivel clip 16 between its closed and open positions. Pressure applied once to the button could place swivel clip 16 into its opened position, while pressure applied twice to the button could place swivel clip 16 into its closed position, or more simply, pressures successively applied to the button could alternative open and close swivel clip 16. Swivel clip 16 could also be biased into a closed position, with a user temporarily opening it to place housing 4 adjacent to a support surface or object (not shown), prior to the release of swivel clip 16 that would fix housing 4 into the desired positions of temporary storage between uses. A small horizontally-extending double-headed arrow shows the direction of movement of swivel clip 16 between its open and locked positions. High friction material 18 on the distal end of swivel clip 16 provides additional help in securing first preferred embodiment 2 into a fixed storage position against the surface or object chosen for supporting it. For example, when swivel clip 16 is supported by a narrow object such as a binder ring (not shown), high friction material 18 is fixed against the outside surface of housing 4 to securely maintain a close association of housing 4 with the binder ring. Otherwise, such as when preferred embodiment 2 is placed into a clothing pocket, high friction material 18 provides a non-slip grip against the pocket fabric instead of housing 4. It is contemplated for high friction material 18 to be resilient, to compensate for differences in thickness of the support surfaces or objects chosen for temporary storage of first preferred embodiment 2 between uses. Although not limited thereto, high-friction material 18 could be made from materials such as rubber, silicone, or latex. The lower end of sleeve 6*a* has an elongated tapering configuration (indicated by the number 46 in FIG. 9) and is shown in FIG. 1 to be more elongated than the shortened and more blunt lower end of the sleeve 6*b* that is shown in the second preferred embodiment 68 in FIG. 2, with the shortened tapering configuration of sleeve 6*b* also identified by the number 28 in FIGS. 4 and 8. As can be further seen in FIGS. 8 and 9, it is contemplated for sleeves 6*a* and 6*b* to have a substantially closed upper end, with only a central opening 22 therethrough that has a dimension sufficient for insertion of marking material cartridge 8. Thus, since the central portion of marking material cartridge 8 extends through central opening 22, as well as through the center of a spring 56 (shown in FIG. 10) and the central opening 22 in a stop disk 32 (shown in FIGS. 3 and 5) that are both positioned above the upper end of sleeve 6*a*, the length of cartridge 8 is not critical and its non-writing end would not require support by the closed upper end of housing 4 for cartridge 8 to remain centrally positioned within housing 4. The marking material 10 used within the cartridge 8 in first preferred embodiment 2 for writing, drawing, coloring, and/or highlighting purposes is shown in FIG. 1 by speckled shading, that might be construed as a liquid or gel. However, it is not contemplated for marking material cartridge 8 to be limited to a cartridge configuration for containing a liquid or gel. Instead, it is considered to be within the scope of the present invention for marking material cartridge 8 to include any hollow or solid configuration that provides any type of marking material 10 for employment in first preferred embodiment 2 for writing, drawings, coloring, and/or highlighting purposes. Although not shown in FIG. 1, the upward movement of sleeve 6*a* longitudinally within housing 4 is limited by the stop disk 32 (shown in FIG. 5 positioned above the upper end of sleeve 6*a*) in combination with the spring 56 (shown in FIG. 5 positioned between stop disk 32 and the top surface of sleeve 6*a*), with spring 56 causing sleeve 6*a* to be biased toward its lowered and protective position around writing tip 12 once the light finger or thumb pressure applied against a sleeve lifting mechanism (not shown in FIG. 1) is removed therefrom. In the alternative, although not shown, for high end embodiments of the present invention, a small battery powered mechanism could be used in place of spring 56 and stop disk 32 to limit the upward movement of sleeve 6 within housing 4 and cause the movement of sleeve 6 toward its protective position around writing tip 12. The external means of raising sleeve 6*a* is hidden from view in FIG. 1, and may be positioned within the area covered by cushioning material 88. However, several alternative means for raising 6*a* are showing in FIGS. 5–7 and 10–18. Further, it is not contemplated for the configuration of sleeve 6 in the present invention to be limited to that of the sleeve 6*a* shown in FIGS. 1 and 9, or that of the sleeve 6*b* shown in FIGS. 2 and 8. Therefore, it is considered for the scope of the present invention to include many alternative sleeve configurations having different combinations of long and short tapering ends, upper configurations for engaging blocks 34 other than the flared upper end 42 and flange 44 respectively shown in FIGS. 8 and 9, different locking mechanisms other than locking mechanisms 20 and 86 respectively shown in FIGS. 8 and 9, and/or different openings other than lifting mechanism openings 82 and 84 also respectively shown in FIGS. 8 and 9.

Figure 8:
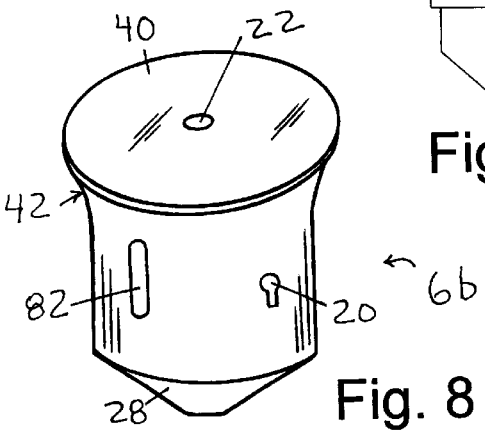
FIG. 8 is a perspective view of a first preferred embodiment of the present invention sleeve having a generally cylindrical configuration, an outwardly flared upper end and a shortened tapering lower end, a top surface with a central opening therethrough, an elongated longitudinally-extending opening centrally through the side surface of the sleeve configured to allow for unrestricted lift mechanism and sleeve movement as the sleeve is raised and lowered, and a keyhole-shaped opening in its outer surface configured to engage a locking mechanism protruding from the interior surface of the housing.

FIG. 2 shows a second preferred embodiment 68 of the present invention having an alternative sleeve 6*b* configuration with its tapered end partially extending from the open lower end of housing 4. Sleeve 6*b* has a shortened and more bluntly tapered distal end extending over writing tip 12, than is shown in FIG. 1 for sleeve 6*a*. In FIGS. 5 and 8 this shortened and more bluntly tapered configuration is identified by the number 28. Although FIGS. 1 and 2 respectively show the elongated tapering configuration 46 of sleeve 6*a* and the shortened tapering configuration 28 of sleeve 6*b* always fully positioned beyond the lower end of housing 4, it is also considered to be within the scope of the present invention for the proximal ends of tapering configurations 28 and 46 to remain partially hidden within housing 4 even when the distal ends thereof are in a fully lowered and protective position covering writing tip 12. FIG. 2 shows sleeve 6*b* in its position of maximum extension beyond housing 4, with an upwardly directed arrow below it showing the upward direction of movement needed for sleeve 6*b* to be raised and again allow writing tip 12 to be available for writing/marking use. It is preferred that sleeve 6*b* not extend a large distance downwardly beyond writing tip 12, but only the minimum distance required to prevent writing tip 12 from applying marking material 10 to other objects and surfaces (not shown) should housing 4 be inadvertently dropped or moved in such a way that would have otherwise placed writing tip 12 in contact with a surface or object not intended for marking. However, it is also considered to be within the scope of the present invention for any sleeve 6 used to move more than the minimum distance required for covering and revealing writing tip 12. Although not shown in FIG. 2, the upper end of sleeve 6*b* would be prevented from being completely withdrawn from housing 4, and there would be means for defining the upper limit of sleeve 6*b* within housing 4, as well as biasing sleeve 6*b* into its lowered and protective position over writing tip 12. Also, although not shown in FIG. 2, it is contemplated for all preferred embodiments to have a sleeve-locking means on housing 4 to prevent sleeve 6*a*, sleeve 6*b*, or other alternative sleeve 6 configuration from being inadvertently raised by casual contact from its lowered and protective position over writing tip 12. Although sleeve 6*a*, 6*b*, and any other sleeve 6 configuration used, must fit closely within housing 4 for stability, the sleeve 6 used must also remain at a spaced-apart distance from housing 4 that allows easy upward and downward movement of sleeve 6 within housing 4 and provides space to position a locking means between housing 4 and sleeve 6, 6*a*, 6*b*, or other sleeve 6 configuration used to maintain that sleeve 6 in a lowered and protective position over writing tip 12 and guard against that sleeve 6 being raised by inadvertent contact before it is deliberately released.

FIG. 3 shows the stop disk 32 used in first preferred embodiment 2 and second preferred embodiment 68 where in its usable position within housing 4 stop disk 32 would be attached to the interior surface of housing 4 above sleeve 6*a*, 6*b*, or other sleeve 6 configuration and used to define the upper limit of movement for that sleeve 6 within housing 4. One example of the distance stop disk 32 would be placed above the top surface of sleeve 6*b* is shown in the fourth preferred embodiment 70 illustrated in FIGS. 5 and 6. In combination with stop disk 32, the spring 56 also shown in FIGS. 5 and 6 helps to bias sleeve 6*b* into its lowered and protective position over writing tip 12. As can be see in FIG. 3, stop disk 32 has a cylindrical configuration 24 and a central opening 22 therethrough. Should the cross-sectional configuration of housing 4 be different from the circular configuration shown in FIG. 4, such as that of a hexagon, octagon, or ellipse, it is contemplated that the cross-sectional configuration of stop disk 32 would have an identical, similar, or otherwise complementary configuration. It is contemplated for central opening 22 in stop disk 32 to be sufficiently large for marking material cartridge 8 to easily pass therethrough, but small enough for stop disk 32 to provide a stabilizing influence on marking material cartridge 8 to maintain it centrally within housing 4 during use.

Figure 9:
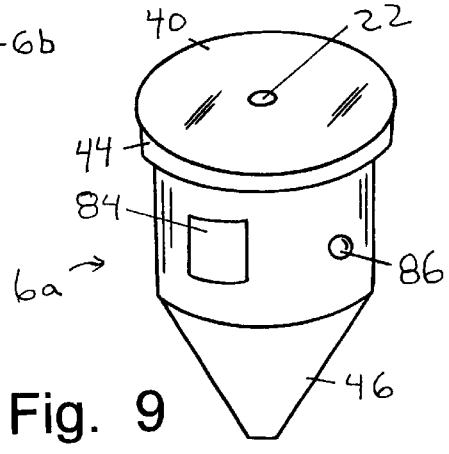
FIG. 9 is a perspective view of a second preferred embodiment of the present invention sleeve having a generally cylindrical configuration, a top surface outwardly extending beyond the cylindrical configuration to create a flange, a central opening through the top surface, an elongated tapering lower end, a large and substantially rectangular opening through one side of the sleeve that is configured to allow for unrestricted sleeve and lifting mechanism movement during the raising and lowering of the sleeve, and a round depression in the outer surface of the sleeve configured to engage a locking mechanism protruding from the interior surface of the housing tha thelps to maintain the sleeve in its lowered and protective position.
Figure 10:
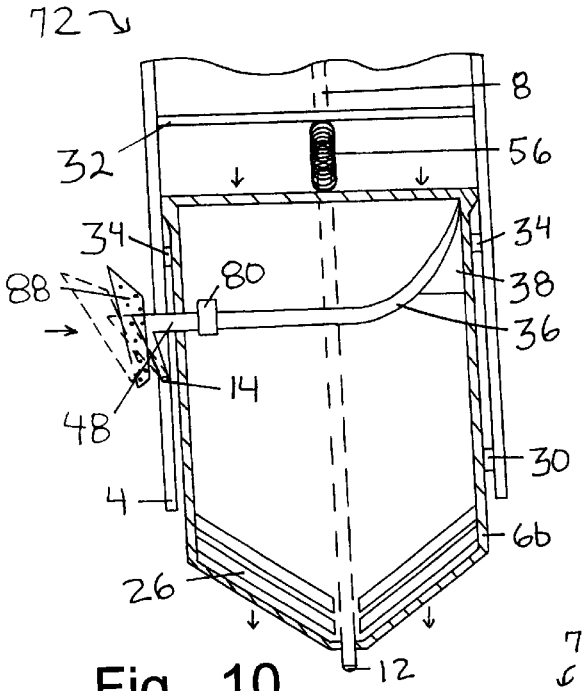
FIG. 10 is a sectional side view of the third preferred embodiment of the present invention having a push bar to raise and lower its sleeve, with the lower end of the push bar connected by a hinge/pin to the housing and the upper end of the push bar connected to the distal end of a flexible lifting rod that translates inward movement of the upper end of the push bar through aligned openings in the housing and sleeve to cause the sleeve to be raised relative to the housing and make the writing tip available for use, the lifting rod having a stop bar thereon to limit the maximum outward movement of the push bar beyond the housing, with the stop bar being shown at a spaced-apart distance from the inside sleeve wall, cushioning material shown secured over the push bar, the sleeve being shown in its raised position and having a flared upper end configured to engage a ridge, shelf, ledge, protrusion, or opposing blocks that limit the downward movement of the sleeve so that it remains at least partially within the housing during use, an unengaged locking mechanism remaining between the housing and the sleeve, four braces extending from the interior sleeve surface toward the marking material cartridge and configured to stabilize the cartridge and writing tip during writing use, and a small horizontally extending arrow showing the inward direction of movement of the upper end of the push bar as it is engaged to raise the sleeve, with broken lines showing the position of the push bar and cushioning material when the sleeve is in its lowered and writing tip protective position and four downwardly extending arrows showing the direction of sleeve movement needed to place the sleeve into its lowered and protective position around the writing tip.
Figure 11:
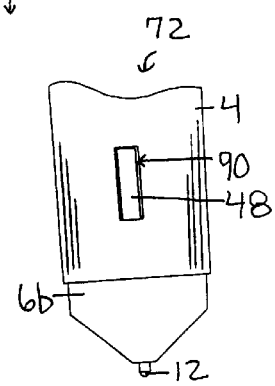
FIG. 11 is a side view of the housing of the third preferred embodiment, showing the apparently unchanged position of the push bar as it would appear to a viewer looking at the push bar with the housing directly behind it during the raising and lowering of the sleeve, the cushioning material shown in FIG. 10 being removed from the push bar.
Figure 12:
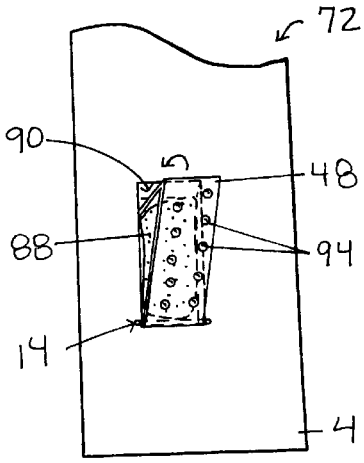
FIG. 12 is a perspective view of the push bar shown in FIG. 10 extending outwardly through an elongated cutout in the third preferred embodiment housing, the push bar being in the extended configuration it would assume when the sleeve is in its lowered and protective position, with cushioning material visible behind the push bar that would provide resiliency to it for enhanced user comfort, and the push bar having a non-slip textured surface with protrusions configured to enhance a users grip, with an arrow indicating the inward direction of movement intended for the upper end of the push bar when it is engaged lightly by a finger or thumb to lift the sleeve and make the writing tip available for use.

FIG. 4 shows a third preferred embodiment 72 of the present invention, which is also shown in FIGS. 10–12, wherein sleeve 6*b* is concentrically positioned within housing 4, a locking mechanism 30 that protrudes from the interior surface of housing 4 is engaged with some feature (such as but not limited to the keyhole-shaped opening 20 shown in FIG. 8) on sleeve 6*b* to prevent sleeve 6*b* from moving out of its protective position until locking mechanism 30 is deliberately released. It is contemplated for activation of the sleeve raising mechanisms in the present invention to be sufficient for release of locking mechanism 30 from keyhole-shaped opening 20 and depression 86. FIG. 4 also shows the tapering end 28 of sleeve 6*b* having a central opening 22 and writing tip 12 positioned within opening 22 and concentrically aligned therewith. FIG. 4 further shows four braces 26 inwardly depending from the interior surface of sleeve 6*b* toward the marking material cartridge 8 rearwardly extending behind writing tip 12, although cartridge 8 is hidden from view on FIG. 4. The distal end of each brace 26 is positioned close to marking material cartridge 8. However, braces 26 are not routinely in contact with marking material cartridge 8 unless pressure applied to writing tip 12 temporarily forces marking material cartridge 8 against one or more braces 26. Although not limited thereto, locking mechanism 30 would preferably be in the form of one or more small protrusions extending beyond the interior surface of housing 4 that would be configured to engage a small depression in, or small keyhole-shaped opening through, sleeve 6*b*, such as but not limited to depression 86 in FIG. 9 and key-hole shaped opening 20 in FIG. 8.

Figure 6:
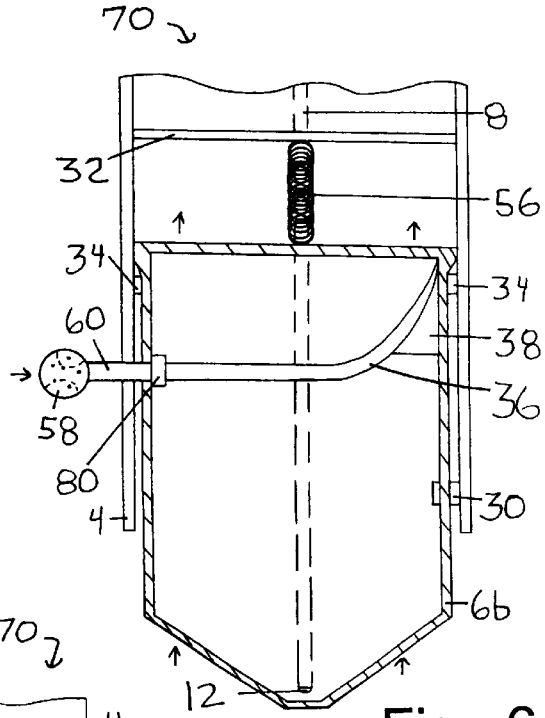
FIG. 6 is a sectional side view of the fourth preferred embodiment of the present invention with the flared upper end of the sleeve engaging a ridge, ledge, protrusion, shelf, or blocks indicating that the sleeve is in its fully lowered and protective position, a depressible button extending through the sleeve and housing and being configured to raise and lower the sleeve relative to the housing via use of a lifting rod, cushioning material in the form of a decorative object attached to the distal end of the button with the button in a position ready to be depressed by a user whereby it would cause the sleeve to be raised and reveal the writing tip for use, a horizontally extending and inwardly directed arrow adjacent to the decorative object showing the direction of button movement needed to raise the sleeve from its protective position, a stop bar attached to the lifting rod that is in contact with the inside sleeve wall, a locking mechanism inwardly depending from the housing and extending through the sleeve prevents inadvertent raising of the sleeve by casual contact, and four upwardly extending arrows show the direction of movement of the sleeve as it travels away from its protective position.
Figure 7:
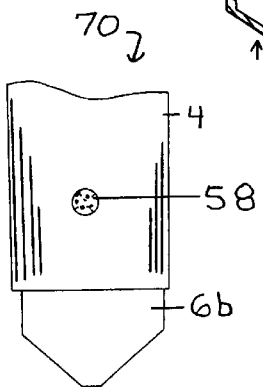
FIG. 7 is a side view of the housing of the fourth preferred embodiment, showing the depressible button covered with a decorative object made from cushioning material as it would appear to a viewer looking at the button with the housing directly behind it, with the button position appearing unchanged whether the sleeve is in its raised or lowered position.

FIGS. 5, 6, and 7 show the fourth preferred embodiment 70 of the present invention with its sleeve 6*b* being raised and lowered by a depressible button 60 covered by cushioning material 88 or a decorative object 58 that can also be optionally made from cushioning/comfort material to enhance user comfort. FIGS. 5 and 6 show depressible button 60 extending beyond housing 4, which when engaged by the light pressure of a user's finger or thumb (not shown) will raise sleeve 6*b* via an attached lifting rod 36. FIG. 5 shows sleeve 6*b* in its raised position exposing writing tip 12, with a locking mechanism 30 between sleeve 6*b* and housing 4 displaying an unengaged configuration. In contrast, in FIG. 6, sleeve 6*b* is in its lowered position, with locking mechanism 30 engaged and its distal end extending through sleeve 6*b*. While in its engaged position, locking mechanism 30 fixes the position of sleeve 6*b* relative to housing 4 and prevents sleeve 6*b* from being easily dislodged from its protective position around writing tip 12 by inadvertent/casual contact with clothing, skin, furniture, carpeting, and other adjacent surfaces. As shown in FIGS. 8 and 9, a keyhole-shaped opening 20 with a round groove upwardly depending from a hollow cell and a circular depression 86 are preferred means of engaging locking mechanism 30, although other locking mechanism 30 engagement means are also considered to be within the scope of the present invention. FIGS. 5 and 6 show sleeve 6*b* having a flared upper end (as shown in FIG. 8 by the number 42). In FIG. 5 flared upper end 42 is at a spaced-apart distance from blocks 34, while in FIG. 6 flared upper end 42 is in contact with opposing blocks 34. Flared upper end 42 is configured to engage opposing blocks 34, or other stopping device such as but not limited to a ridge, protrusion, shelf, or ledge (not shown) that could extend part or all of the way around the interior circumference of housing 4, and is attached to housing 4 and positioned so as to define the lower limit of longitudinal movement of sleeve 6*b* within housing 4 while concurrently preventing the complete withdrawal of sleeve 6*b* from housing 4. The configuration of flared upper end 42 is not critical and it is contemplated for sleeve 6*b* and other sleeves 6 used as a part of the present invention to have other upper end configurations, such as but not limited to that of the flange 44 shown in FIG. 9, as long as each successfully fulfills its withdrawal preventing function. In the alternative, although not shown, as long as the structure identified by the number 34 keeps sleeve 6*a* from being totally withdrawn from housing 4, blocks 34 may have any configuration that fulfills its withdrawal prevention function for sleeve 6, such as but not limited to one or more rectangular-shaped protuberances inwardly depending from the interior surface of housing 4, one or more arcuate or oval protuberances, one or more elongated protuberances each extending across less than half the circumference of the interior surface of housing 4, an arcuate or linear shelf or ledge, or an angled ridge extending around the entire interior circumference of housing 4. Stop disk 32 is in the same fixed position within housing 4 in both FIGS. 5 and 6, however, with sleeve 6*b* being raised in FIG. 5, the spring 56 shown in FIG. 5 is compressed into a shorter configuration than is shown for spring 56 in FIG. 6, where sleeve 6*b* is in its lowered and protective position covering writing tip 12. FIG. 6 further shows a decorative object 58 attached to depressible button 60. Although decorative object 58 appears to be in the shape of a baseball, softball, or tennis ball, it is also contemplated for decorative object 58 to have other sports-related and other non-sports-related configurations, such as but not limited to a football, an animal, the product manufactured by a company, or a team mascot. Also, although decorative object 58 could be made from rigid material and housing 4 could be configured for temporary positioning of decorative object 58 flush with housing 4 to provide enhanced finger comfort for a user while depressible button 60 is depressed to raise sleeve 6*b* from its lowered and protective position, it is preferred for decorative object 58 to be made from flexible material that is comfortable to the user's finger or thumb while he or she engages depressible button 60 to raise sleeve 6*b* during writing/marking use of fourth preferred embodiment 70. FIGS. 5 and 6 further show depressible button 60 connected to the distal end of a lifting rod 36, the proximal end of which is held in place against the interior surface of sleeve 6*b* by a ramp 38. It is preferred for lifting rod 36 to be flexible and made from thin plastic, nylon, or metal, although not limited thereto. A stop bar 80 is firmly attached to lifting rod 36 in a non-sliding relation near to the distal end of lifting rod 36, in a position to define the maximum amount of movement of depressible button 60 beyond housing 4. The configuration of stop bar 80 is not critical and may vary from the simple rectangular shape shown in FIGS. 5 and 6. Since the sleeve 6*b* shown in FIG. 6 is in its fully lowered and protective position, the depressible button 60 shown in FIG. 6 is correspondingly at its maximum extension beyond housing 4, being prevented from further outward movement away from housing 4 by stop bar 80 contact with the interior surface of sleeve 6*b*. Conversely, the stop bar 80 in FIG. 5 is at a spaced-apart distance from the interior surface of sleeve 6*b*. In addition, FIGS. 5 and 6 show marking material cartridge 8 centered and extending longitudinally through housing 4, sleeve 6*b*, spring 56, and stop disk 32. Although not clearly illustrated in FIGS. 5 and 6 due to the perspective shown, marking material cartridge 8 would not extend through lifting rod 36. Instead, it is contemplated for lifting rod 36 to be angled so as to avoid contact with marking material cartridge 8, or made with a forked or other configuration that allows it to extend beyond cartridge 8. A double-headed horizontally-extending arrow in FIG. 5 shows the inward and outward movement of depressible button 60 as sleeve 6*b* is raised and lowered, while the inwardly directed and horizontally-extending arrow in FIG. 6 shows the inward movement needed to raise sleeve 6*b* from its illustrated position of maximum extension used to protect writing tip 12 from inadvertent contact with other surfaces and objects, such as but not limited to the fabric of a clothing pocket (not shown). In addition, two small downwardly directed arrows above the upper surface of sleeve 6*b* and two small downwardly directed arrows below the tapered end of sleeve 6*b* shown the direction of movement needed in FIG. 5 to lower sleeve 6*b* into its protective position around writing tip 12. Conversely, in FIG. 6 similarly positioned upwardly directed arrows in show the direction of movement needed to raise sleeve 6*b* from its fully protective position. FIG. 7 shows the depressible button 60 in fifth preferred embodiment 70 covered by a decorative object 58, as it would appear to a viewer looking at depressible button 60 with housing 4 directly behind it when sleeve 6*b* is in its lowered and protective position. However, the position of decorative object 58 and depressible button 60 remains unchanged from this viewpoint whether the sleeve 6*a* is in its raised or lowered position.

Figure 15:
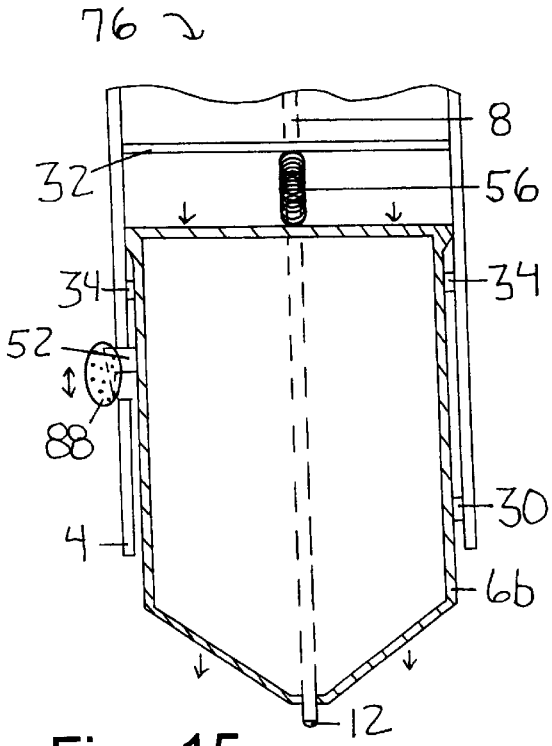
FIG. 15 is a sectional side view of a sixth preferred embodiment of the present invention having a sliding mechanism to raise and lower its sleeve, the sliding mechanism being connected to the exterior surface of the sleeve, a small vertically extending double-headed arrow showing the direction of sliding mechanism movement as it is engaged by light finger pressure to raise and lower the sleeve, and an opening through the housing that allows unrestricted vertical movement of the sliding mechanism, with cushioning material secured over the sliding mechanism and four downwardly extending arrows showing the direction of movement of the sleeve as it would travel toward its protective position.

FIGS. 8 and 9 show first and second preferred configurations for the sleeve 6 used in the present invention, with FIG. 8 showing sleeve 6*b* with a flared upper end 42 and FIG. 8 showing sleeve 6*a* with a flange 44 extending laterally outward from its upper end. FIGS. 8 and 9 respectively show sleeve 6*b* and 6*a* each having a generally cylindrical configuration with a central opening 22 through its substantially planar top surface 40. In addition, FIGS. 8 and 9 each show a portion of a locking mechanism used between housing 4 and sleeve 6 for engaging locking mechanism 30 so as to maintain sleeve 6 in its lowered and protective position around writing tip 12, substantially protected from premature release by casual contact. FIG. 8 and 9 each also show a centrally positioned lift apparatus opening, respectively identified by the numbers 82 and 84, through one side of sleeve 6 of sufficient dimension to allow unrestricted raising and lowering of sleeve 6 and any lifting mechanism connected thereto that extends into and beyond housing 4. Such an opening would not be required when the sliding mechanism of FIG. 15 is used, since it attaches directly to the exterior surface of sleeve 6*b*. FIG. 8 further shows the tapering end 28 of sleeve 6*b* being shorter and more blunt than that the elongated tapering configuration 46 of the sleeve 6*a* shown in FIG. 9. In FIG. 8, the locking mechanism shown is a keyhole-shaped opening 20 centrally through the outer surface of sleeve 6*b*, with an upper groove upwardly extending from a hollow cell. As sleeve 6*b* moves downwardly into its protective position covering writing tip 12, the locking mechanism 30 protruding from the interior surface of housing 4 moves through the upper groove of keyhole-shaped opening 20 to secure sleeve 6*b* to housing 4 and guard against premature release of sleeve 6*b* from its protective position as a result of casual contact. In contrast, the locking mechanism shown in FIG. 9 is a depression 86 in the outer surface of sleeve 6*a* that does not extend all the way through the wall surface of sleeve 6*a*. It is contemplated that the configuration of depression 86 will be sufficient in size and shape to hold sleeve 6*b* in its protective position and guard against premature release by casual contact. Keyhole-shaped opening 20 and depression 86 are each configured to provide easy yet firm engagement with the protruding locking mechanism 30 outwardly depending from the interior surface of housing 4, so that engagement is prompt, but not inadvertently disrupted by casual contact when the present invention falls out of a person's hand and onto clothing, skin, books, furniture, and/or carpeting and rugs. Further, release of the protruding locking mechanism 30 from either keyhole-shaped opening 20, or circular depression 86, must be accomplished by engaging the activating mechanism used to raise sleeve 6*a*, 6*b*, or other sleeve 6 configuration. The configuration of the lift apparatus opening through sleeve 6*a* or 6*b* may vertically elongated, as shown by narrow opening 82 in FIG. 8 that extends through one side of sleeve 6*b* at a spaced-apart distance from keyhole-shaped opening 20. The lift apparatus opening may also be configured as the large rectangular opening 84 in FIG. 9, having sufficient size to allow for unrestricted sleeve 6*a* or 6*b* and lifting mechanism movement during the raising and lowering of sleeve 6, or to save on material expense during manufacture of sleeve 6. Large rectangular opening 84 and narrow opening 82 are provided only as examples of two possible configurations and dimensions of lift apparatus openings, and it is considered within the scope of the present invention for any needed lift apparatus openings to have other appropriate sizes and shapes.

FIGS. 10–18 show alternative means of raising sleeves 6*a* and 6*b*. However, each could also be used to lowered sleeves 6*a* and 6*b* in manually operating embodiments, as well as raise and/or lower other configurations of sleeve 6 used. FIG. 10 shows the third preferred embodiment 72 of the present invention having a push bar 48 to raise sleeve 6*b* via use of a connected flexible lifting rod 36 that is secured on its proximal end to the interior surface of sleeve 6*b* by a ramp 38. In the alternative, although not preferred and not shown, lifting rod 36 could be attached to the inside top surface of sleeve 6*b*. FIG. 10 shows sleeve 6*b* in a raised orientation, braces 26 extending from the interior surface of sleeve 6*b* toward marking material cartridge 8 to stabilize it and writing tip 12 during writing use, if required, and spring 56 compressed between the top surface of sleeve 6*b* and the bottom surface of stop disk 32. The number, size, configuration, and positioning of braces 26 used are not critical, with four or eight equally spaced-apart braces 26 in one or two rows being preferred. When braces 26 are used, although not limited thereto it is contemplated that braces 26 would be made a part of sleeve 6*a*, 6*b*, or other sleeve 6 used, during manufacture via molded construction. Since sleeve 6*b* is illustrated in its raised position in FIG. 10, the locking mechanism 30 on the interior surface of housing 4 is unengaged with sleeve 6*b*, and the flared upper surface of sleeve 6*b* is at a spaced-apart distance above blocks 34. In addition, FIG. 10 shows a quantity of cushioning material 88 secured to the surface of push bar 48 that would be engaged by a user's finger or thumb to place sleeve 6*b* in its raised position that allows writing/marking use of writing tip 12. In the alternative, as shown in FIG. 12, cushioning material 88 could be placed under push bar 48 for user comfort, or as shown in FIG. 11, no cushioning material 88 need be employed. However, in most preferred embodiments of the present invention, some cushioning material 88 would be used. It is contemplated for the cushioning material 88 employed with the present invention to be resilient, soft, and/or have any other ergonomic characteristics that enhance user comfort during extended use of the present invention. The solid lines used in FIG. 10 for push bar 48 and cushioning material 88 show their positions when sleeve 6*b* is in its raised condition, with the broken lines defining the positions of push bar 48 and cushioning material 88 when sleeve 6*b* is in its lowered and protective position around writing tip 12. Although not shown in broken lines, when sleeve 6*b* is in its lowered position, stop bar 80 would be in contact with the interior wall of sleeve 6*b*. The lower end of push bar 48 is connected at its pivot point by a hinge/pin 14 to housing 4, whereby inward movement of the upper end of push bar 48 through aligned openings in housing 4 and sleeve 6*b* cause engagement of the lifting rod 36 that raises sleeve 6*b* within housing 4. Although not limited thereto, in the most preferred embodiments it is contemplated for sleeve 6*a* or 6*b* to travel only a short distance when it is moved from its raised position to its lowered and protective position around writing tip 12, perhaps only one-fourth or three-eighths of an inch. It is also contemplated for lifting rod 36 to have a stop bar 80 fixed thereto to limit the maximum outward movement of the upper end of push bar 48 beyond housing 4. Further, in FIG. 10 a small horizontally extending arrow shows the direction of movement of the upper end of push bar 48 as it is engaged to raise sleeve 6*b*, and four downwardly extending arrows showing the direction of sleeve movement needed to place sleeve 6*b* into its lowered and protective position around writing tip 12. FIG. 11 shows third preferred embodiment 72 with its push bar 48 movable within a channel/opening 90 and having no apparent change in position visible to a viewer looking at push bar 48 with housing 4 directly behind it during the raising or lowering of sleeve 6*b*. As can be further seen in FIG. 12, push bar 48 extends outwardly through an elongated channel/opening 90 in housing 4, with push bar 48 being in the extended configuration it would assume when sleeve 6*b* is in its lowered and protective position around writing tip 12, with a quantity of cushioning material 88 visible behind the rear surface of push bar 48 that would provide resiliency to it for enhanced user comfort, with an arrow indicating the inward direction of movement intended for the upper end of push bar 48 when light pressure is applied by a finger or thumb (not shown) to engage lifting rod 36 to raise sleeve 6*b* immediately prior to writing tip use. In addition, FIG. 12 shows push bar 48 having a plurality of protuberances 94 on its outside surface configured and positioned to enhance a user's grip. The use of protuberances 94 is not critical and the number may vary according to the intended application. The protuberances 94 may be soft, rigid. and/or textured when used.

Figure 13:
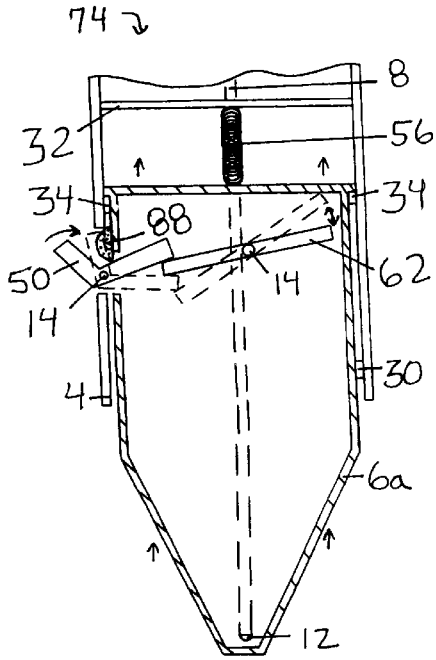
FIG. 13 is a sectional side view of a fifth preferred embodiment of the present invention having a lever/bar combination that is used with a second pivoting bar to raise and lower its sleeve, with the lever portion of the lever/bar combination pivoting rearwardly toward the housing as pressure is applied thereto by a user's finger or thumb whereby bar portion of the lever/bar engages one end of the second bar which then pivots so that its opposed end contacts the inside top surface of the sleeve to raise it, the fifth embodiment also having a pin securing the lower end of the lever portion to the housing with an arrow adjacent to the lever portion pointing toward the interior of the housing to show the inward direction of movement of the upper end of the lever portion required to raise the sleeve, and cushioning material behind the lever portion to provide comfort to the user's finger or thumb holding the lever portion against the housing when the sleeve is raised, with the sleeve being shown in its lowered position and broken lines showing the positions of the lever/bar combination and second pivoting bar when the sleeve is in its raised position, the locking mechanism engaged, although not extending through the sleeve since it has a circular depression instead of a keyhole-shaped opening, its sleeve having a flange engaging a ridge, ledge, shelf, protrusion, or opposing blocks that define the lower limit of sleeve movement whereby the sleeve is able to remain at least partially within the housing during use, with four upwardly extending arrows showing the direction of sleeve movement needed to place the sleeve into the raised position needed to make the writing tip available for use.
Figure 14:
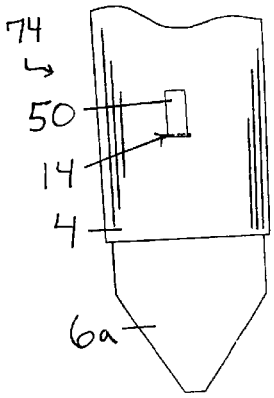
FIG. 14 is a side view of the housing of the fifth preferred embodiment, showing the lever as it would appear to a viewer looking at the lever with the housing directly behind it, with the lever position appearing substantially unchanged to the viewer whether the sleeve is in its raised or lowered position, and from this same viewpoint the two pivoting bars and the cushioning material remaining hidden from the viewer.

FIGS. 13 and 14 show a fifth preferred embodiment 74 of the present invention having a lever/bar combination 50 to raise and lower its sleeve 6*a*, the lever portion of lever/bar combination 50 pivoting rearwardly toward housing 4 to move its attached bar portion into a position of contact with a second pivoting bar 62, the remote end of which then contacts the inside top surface of sleeve 6*a* to raise it. As with any of the activating mechanisms of the present invention employed to raise sleeve 6*a*, lever/bar combination 50 can be used to raise sleeve 6*a*, 6*b*, or any other configuration of sleeve 6. Lever/bar combination 50 can also be used to lower sleeves 6*a*, 6*b*, and 6 in manually operated embodiments. A hinge/pin 14 secures the lower end of lever/bar combination 50 to housing 4, and a small arrow pointing toward the interior of housing 4 shows the rearward direction of movement of the upper end of the lever portion of lever/bar combination 50 toward housing 4 as it is engaged by a finger or thumb (not shown) to raise sleeve 6*a*. In FIG. 13, sleeve 6*a* is in its lowered position covering writing tip 12, with broken lines show the position of the lever portion of lever/bar combination 50 and the pivoting bar 62 it engages when sleeve 6*a* is in its raised position. A quantity of resilient cushioning material 88 is shown behind lever/bar combination 50. It can be attached to the rear surface of lever/bar combination 50, or secured to housing 4 where it can be in contact with lever/bar combination 50 at all times, or only when lever/bar combination 50 moves toward housing 4 as a result of the light pressure applied by a user's finger or thumb. Further, similar to the configuration shown in FIG. 12 for push bar 48, a channel 90 lined with cushion material 88 could also be used with lever/bar combination 50 to enhance user comfort when sleece 6*a* is raised and writing tip 12 is being used. FIG. 13 further shows locking mechanism 30 positioned between sleeve 6*a* and housing 4, where it would be engaged with the depression 86 shown in FIG. 9 to fix the position of sleeve 6*a* relative to housing 4 so that sleeve 6*a* cannot be inadvertently or otherwise prematurely removed from its protective position around writing tip 12 by casual contact should it fall against clothing, skin, furniture, books, and or other markable surfaces or objects (not shown). The sleeve 6*a* shown in FIG. 13 also has a flange 44 configured for engaging blocks 34 that define the lower limit of movement for sleeve 6*a* within housing 4 so that sleeve 6*a* remains at least partially within housing 4 at all times during use. Further, since the sleeve 6*a* shown in FIG. 13 is in its lowered and protective position, the bottom surface of flange 44 is in contact with blocks 34. In place of blocks 34, the stopping mechanism for sleeve 6*a* can be a ledge, shelf, ridge, one or more protuberances, or any configuration of structure that can complement flange 44 so as to prevent sleeve 6*a* from being totally withdrawn from housing 4 during use. Four upwardly extending arrows in FIG. 13 show the direction of movement needed for sleeve 6*a* to be placed into its raised position relative to writing tip 12. Another substantially horizontally-extending arrow near the upper end of lever/bar combination 50 shows the inward movement needed for the upper end of lever/bar combination 50 to engage the adjacent end of second pivoting bar 62 so that the remote end of second pivoting bar 62 can contact the interior upper surface of sleeve 6*a* to raise sleeve 6*a* out of its protective position around writing tip 12. FIG. 14 shows the lever portion of lever/bar combination 50 as it would appear to a viewer looking at it with housing 4 directly behind it, with the position of the lever portion of lever/bar combination 50 remaining unchanged from a straight forward viewpoint whether sleeve 6*a* is in its raised or lowered position. Broken lines show the hinge/pin 14 about which the lever portion of lever/bar combination 50 rotates as it moves rearwardly toward housing 4 when sleeve 6*a* is raised. If a channel 90 and cushion material 88 are used behind lever/bar combination 50, the channel 90 employed would appear similarly configured to that shown behind push bar 48, but in FIG. 14 the cushioning material 88, if used, would be substantially hidden from view.

Figure 16:
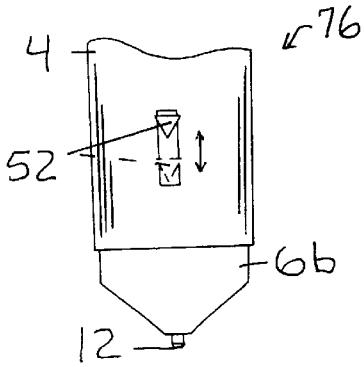
FIG. 16 is a side view of the housing of the sixth preferred embodiment, showing the sliding mechanism in solid lines as it would appear to a viewer looking at the sliding mechanism with the housing directly behind it, with a vertically extending double-headed arrow showing the upward and downward direction of sliding mechanism movement, and broken lines showing the sliding mechanism in the position it would assume relative to the housing when the sleeve is lowered into its protective position.

FIGS. 15 and 16 show a sixth preferred embodiment 76 of the present invention having a sliding mechanism 52 used in combination with the light pressure of a person's finger or thumb to raise its sleeve 6*b*. Sliding mechanism 52 would also be used to lower sleeve 6*b* in the less preferred mechanical embodiments. Sliding mechanism 52, and other activating mechanisms shown in the illustrations hereinto raise sleeve 6*b*, are also usable to raise sleeve 6*a* and any other sleeves 6 employed that are different in configuration from sleeves 6*a* and 6*b*, as shown in FIGS. 8 and 9. FIG. 15 shows the proximal end of sliding mechanism 52 being connected to the exterior surface of sleeve 6*b*. A small vertically extending doubled-headed arrow adjacent to sliding mechanism 52 shows the direction of movement intended for sliding mechanism 52 as it is engaged to raise and lower sleeve 6*b*. Also, four downwardly extending arrows show the direction of movement for sleeve 6*b* as it travels toward its protective position around writing tip 12. FIG. 15 shows sleeve 6*b* in a raised position wherein writing tip 12 is available for use, with spring 56 compressed between the top surface of sleeve 6*b* and the bottom surface of stop disk 32 ready to bias sleeve 6*b* back into its protective position once a user releases finger pressure on sliding mechanism 52. Since sleeve 6*b* is raised, the locking mechanism 30 on the interior surface of housing 4 is unengaged with the keyhole-shaped opening 20 through sleeve 6*b* that is shown in FIG. 8, and the flared upper surface of sleeve 6*b* is positioned at a spaced-apart distance above blocks 34, not in contact with them. In addition, FIG. 15 shows a quantity of cushioning material 88 secured over the exposed surface of sliding mechanism 52 for enhanced user comfort during the extended time a user's fingers or thumb would be used to raise sleeve 6*b* away from writing tip 12. While the use of cushioning material 88 is not required, and may be permanently or detachably secured to sliding mechanism 52, it is preferred for cushioning material 88 to be used and for it to be made from soft materials that conform to the shape of a user's finger or thumb when light finger pressure is applied to sliding mechanism 52. Although cushioning material 88 is shown in FIG. 15 in the general configuration of a football, it is also contemplated for cushioning material 88 to have any other configuration that would enhance the comfort of a users fingers and hand. Also, although not shown, a small groove or notch could be used with sliding mechanism 52 to assist a user in moving sliding mechanism 52 and/or maintaining sliding mechanism 52 in the fixed position that places sleeve 6*b* in its fully raised configuration elative to writing tip 12, particularly when a manual option is provided for lowering sleeve 6*b*. No cushioning material 88 is shown behind sliding mechanism 52, as cushioning material 88 so positioned would provide no significant advantage for a user, since the movement of sliding mechanism is parallel to housing 4 and not perpendicular to it. FIG. 16 shows sliding mechanism 52 as it would appear to a viewer looking at it with housing 4 directly behind it. Broken lines showing sliding mechanism 52 in the position it would assume relative to housing 4 when sleeve 6*b* is lowered into its protective position around writing tip 12. Although not marked in FIG. 16, the exterior surface of sleeve 6*b* would most likely be visible behind sliding mechanism 52 within the unnumbered cutout/channel through housing 4 that is used for movement of sliding mechanism 52. The vertically-extending double-headed arrow in FIG. 16 shows the upward and downward direction of movement for sliding mechanism 52 as travels during the raising and lowering of sleeve 6*b* relative to writing tip 12.

Figure 17:
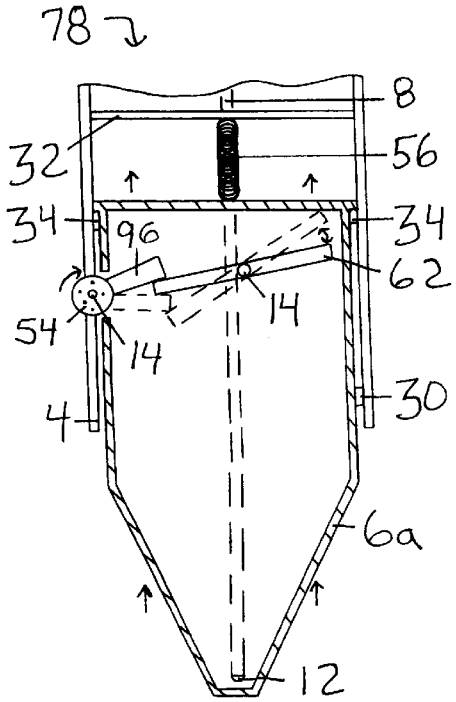
FIG. 17 is a sectional side view of a seventh preferred embodiment of the present invention having a roll ball/extension bar combination that is used with a second pivoting bar to raise and lower its sleeve, with the roll ball positioned within the housing wall where it can be rotated by a finger or thumb around a hinge/pin to raise and lower the sleeve, the roll ball being preferably made from cushioning material and the extension bar depending rearwardly from the roll ball into the interior of the sleeve where its distal end pivots in a downwardly direction as a result of the upper side of the ball being rotated inwardly, whereby after inward roll ball rotation the distal end of the extension bar pushes downwardly against the adjacent end of the second pivoting bar so as to raise the opposing end of the second pivoting bar until it contacts the interior top surface of the sleeve to raise it, a small curved arrow showing the clockwise direction of roll ball movement needed to raise the sleeve, the sleeve being shown in its lowered position and broken lines showing the orientation of the extension bar and second pivoting bar when the sleeve is in its raised position, with four upwardly extending arrows showing the direction of sleeve movement as it leaves its protective position to make the writing tip available for use.
Figure 18:
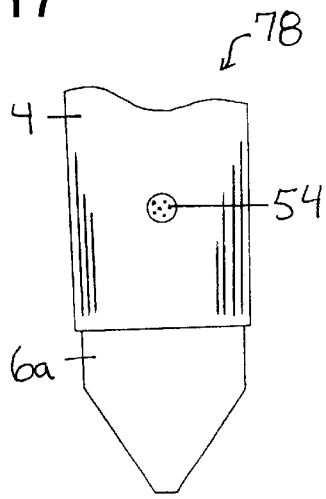
FIG. 18 is a side view of the housing of the seventh preferred embodiment, showing the roll ball as it would appear to a viewer looking at the roll ball with the housing directly behind it, and since the roll ball rotates around a hinge/pin secured within the housing it appears unchanged to the viewer whether the sleeve is in its raised or lowered position.
Figure 19:
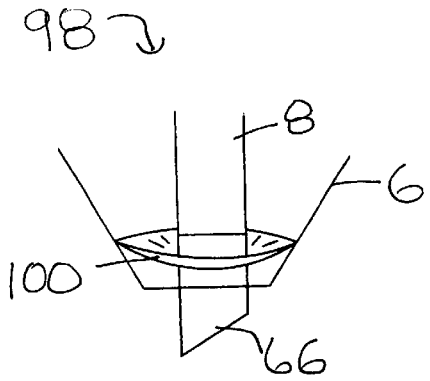
FIG. 19 is a sectional side view of an eighth preferred embodiment of the present invention configured as a marker and showing the sleeve raised so that the broad marking tip extends beyond the sleeve where it is available for use, with a flexible insert positioned within the sleeve near to its open lower end and the broad marking tip extending centrally through the insert.

FIGS. 17 and 18 show a seventh preferred embodiment 78 of the present invention having a roll ball 54 positioned within an opening in the wall of housing 4 for raising sleeve 6*a* relative to writing tip 12. Roll ball 54 has a rearwardly depending extension 96 positioned so that as roll ball 54 is rotated by a user's finger or thumb (not shown) around a pin 14, extension 96 also rotates into a position where it is able to engage a second pivoting bar 62, the other end of which is made to contact the interior top surface of sleeve 6*a* and raise it. It is contemplated for extension 96 to be fixed in position relative to roll ball 54 and not rotate independently from roll ball 54. A small curved arrow adjacent to roll ball 54 shows the clockwise direction of movement needed by roll ball 54 for its extension 96 to engage second pivoting bar 62 and raise sleeve 6*a*. In contrast, it is contemplated for counterclockwise movement of roll ball 54 to lower sleeve 6*a* into its protective position around writing tip 12 in manually operated embodiments. Similar to the other activating mechanisms for sleeve 6*a* provided as a part of the present invention, roll ball 54 can also be used with sleeve 6*b* and most other alternative configurations of sleeve 6 as long as activation mechanism openings 82 and 84 are sufficient in size to accommodate the positioning and movement of roll ball 54 and its extension 96. FIG. 17 further shows sleeve 6*a* being in its lowered position with broken lines showing the orientations of extension 96 and second pivoting bar 62 when sleeve 6*a* is in its raised position. The four upwardly-extending arrows in FIG. 17 show the direction of movement for sleeve 6*a* as it travels out of its protective position around writing tip 12. FIG. 18 shows roll ball 54 as it would appear to a viewer looking at it with housing 4 directly behind it. Roll ball 54 would appear unchanged to the viewer whether sleeve 6*a* is in its lowered or raised position, as roll ball 54 rotates around a pin 14 secured within housing 4 and does not change position relative to housing 4 as sleeve 6*a* is raised. Roll ball 54 can be made from cushioning material 88 and/or have a decorative appearance, or be rigid and/or unadorned. Further, roll ball 54 is not limited to the spherical configuration shown in FIGS. 17 and 18, and may also have the appearance of any object that is rotatable around an axis. As a result, the decorative appearance of roll ball 54 could be made to resemble that of most sports balls, such as but not limited to soccer balls, baseballs, golf balls, and footballs.

Figure 20:
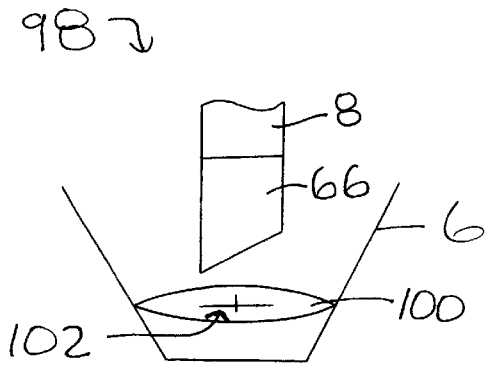
FIG. 20 is a sectional side view of the eighth preferred embodiment of the present invention configured as a marker and showing the sleeve in its lowered and protective position around the broad marking tip, the marking tip being positioned above the flexible insert, and the insert stretched across the lower end of the sleeve with its central opening closed to prevent the marking tip from drying out.
Figure 21:
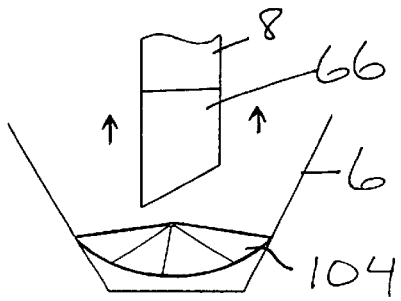
FIG. 21 is a sectional side view of a ninth preferred embodiment of the present invention configured as a marker with the sleeve in its lowered and protective position around the broad marking tip and an insert with an overlapping triangular type of folded configuration positioned within the sleeve below the marking tip to substantially seal the open end of the sleeve and keep the marking tip from drying out between uses, and arrows showing the upward direction of sleeve movement required to force the marking tip through the expandable central opening in the insert.
Figure 22:
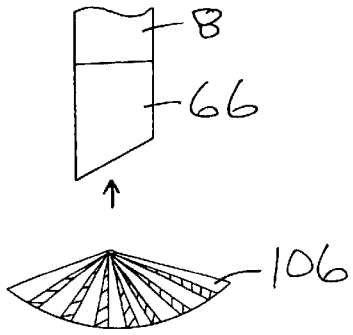
FIG. 22 is a side view of an alternative fan-folded insert with an expandable configuration for use in a tenth preferred embodiment of the present invention to prevent its marking tip from drying out between uses, with an arrow showing the upward direction of insert movement required to force the marking tip through its expandable central opening.
Figure 23:
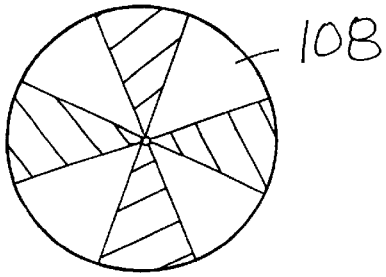
FIG. 23 is a top view of an alternative insert configuration for use in an eleventh preferred embodiment of the present invention to prevent its marking tip from drying out between uses, with alternate raised and recessed adjacent wedge-shaped sections around a small opening that would be stretched by the marking tip and snugly fitting around the marking tip as the sleeve is raised to make the distal end of the marking tip available for writing/marking use.
Figure 24:
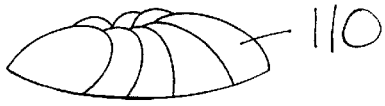
FIG. 24 is a perspective view of an alternative overlapping insert configuration for use in a twelfth preferred embodiment of the present invention to prevent its marking tip from drying out between uses, with the overlapping sections having an arcuate configuration.

FIGS. 19–24 show several different preferred configurations of insert usable within sleeve 6 when the writing/marking tip 12 or 66 is at risk for drying out between uses. FIGS. 19–20 show the eighth preferred embodiment 98 of the present invention configured as a marker or highlighter, with a flexible/stretchable and substantially disk-shaped insert 100 being used adjacent to the open distal end of sleeve 6 to keep its marking tip 66 from drying out between uses when sleeve 6 is in its lowered and protective position around marking tip 66. The larger size of broad marking tip 66 needed in many markers and highlighters, as compared to the smaller writing tip 12 of pens and pencils shown in other embodiments, requires a larger end opening in sleeve 6 and makes the need for some sort of cover over the open distal end of sleeve 6 more critical. Although disk-shaped insert 100 is preferably attached to sleeve 6 at a distance of approximately one-eighth of an inch from its distal end, the gap between disk-shaped insert 100 and the distal end of sleeve 6 is not critical. It is not contemplated for the disk-shaped insert 100 shown in FIGS. 19 and 20 to be the only means employed to prevent marking tip 66 from drying out between uses, and other types of inserts, covers, trap doors, and the like, are alternatively contemplated for use. FIG. 19 shows flexible disk-shaped insert 100 within sleeve 6 in a position near to the open distal end of sleeve 6 where insert 100 substantially blocks the distal opening through sleeve 6 and keeps the marking tip 66 attached to marking material cartridge 8 from drying out between uses. Although not visible in FIG. 19, a small expandable circular, elliptical, or oval opening could be centered in disk-shaped insert 100, or in the alternative some other configuration of opening could exist through insert 100, such as but not limited to the X-shaped slit opening 102 shown in FIG. 20. Since it is contemplated for insert 100 to be made from a very thin stretchable material, such as but not limited to rubber, latex, plastic, or gel, that would substantially recover its original configuration after being stretched, the circular, elliptical, oval, star-shaped, or other expandable opening centrally through disk-shaped insert 100 allowing marking tip 66 to pass through insert 100 as sleeve 6 moves into its raised position, would be very small or almost non-existent when marking tip 66 is removed from insert 100 and sleeve 6 is again placed into its lowered and protective position around marking tip 66. The central opening through insert 100 can be cut though insert 100, such as but not limited to that shown in FIG. 20, or formed via overlapping or folding adjacent sections that substantially come together at their distal ends, although they may not fully do so, such as but not limited to the configurations of inserts 104, 106, 108, and 110 shown respectively in FIGS. 21–24. In FIG. 19, marking tip 66 is shown extending through insert 100 and beyond the open end of sleeve 6. In contrast, FIG. 20 shows insert 100 in a stretched configuration across sleeve 6 near to its open end, with the distal end of marking tip 66 positioned above insert 100 and ready to extend through the X-shaped slit opening 102 the next time sleeve 6 is raised to make marking tip 66 available for writing/marking use. In FIG. 21 insert 104 is shown to have configuration made from overlapping triangles, while in FIG. 22 the configuration of the insert 106 positioned under marking tip 66 is fan-folded. Further, the insert 108 in FIG. 23 has alternating raised and recessed wedge-shaped sections, with the shaded sections indicating those sections that are recessed, while the insert 110 in FIG. 24 has an overlapping configuration with an arcuate upper structure. Although not shown, it is also considered to be within the scope of the present invention for the sealing means employed in the tapering end of sleeve 6 to prevent marking tip 66 from drying out to be in the form of a hinged cover, sliding cover, or trap door, that is moved away from its sealing position when sleeve 6 is raised for marking tip 66 use, and then returned to its sealing position as sleeve 6 is lowered into its protective position around marking tip 66. Should any trap door, cover, or insert used require an extension member to activate it, although not shown, it is contemplated that the extension member could be attached to lifting rod 36, sliding mechanism 52, pivoting bar 62, or other appropriate present invention component. For the insert 100 shown in FIG. 19, as sleeve 6 is raised from its protective position around marking tip 66, the distal portion of marking tip 66 is forced through insert 100. Marking tip 66 must have sufficient rigidity to cause insert 100 to stretch around it, and thereafter, during use of marking tip 66, insert 100, as well as inserts 104, 106, 108, and 110, all remain in close association with marking tip 66. Also, although not critical, it is preferred for insert 100 to be transparent or have the same color as the marking material 10 within the cartridge 8 attached to marking tip 66. In the alternative, insert 100 could also be made to change color as writing tip 66 extends through it. When sleeve 6 is lowered back into its protective position around marking tip 66 and as sleeve 6 passes downwardly beyond marking tip 66, insert 100 is released from its contact with marking tip 66 and resumes its prior substantially closed configuration that seals the end of sleeve 6 so as to prevent marking tip 66 from drying out between uses. Arrows in FIGS. 21 and 22 show arrows that indicate the upward direction of movement for sleeve 6 that is required to force marking tip 66 through the expandable central opening in the respective inserts 104 and 106.

It should be understood that none of the above illustrations shown in FIGS. 1–24 are strictly to scale, but instead provide an artistic representation of some alternatives for the construction of various preferred components and embodiments of the present invention. The illustrations do not provide all possible embodiments of the present invention. Therefore, to determine the scope of the present invention, one should examine the claims and not rely on the illustrations herein to reveal all of the structural combinations that are considered a part of the present invention.

In the following discussion, the mention of sleeve 6 is meant to encompass sleeve 6*a*, 6*b*, and any alternative sleeve 6 configuration contemplated for use as a part of the present invention. The materials used for the components of the present, including sleeve 6, can vary depending upon whether a high-end product or a low-end product is desired, as well as according to the decorative look desired. Preferably, although not limited thereto, housing 4, swivel clip 16, and sleeve 6 in most embodiments of the present invention would be made from stainless steel, other metals, or plastic. The color of present invention components is not critical. However, color may be used to distinguish the present invention from other products or place emphasis on sleeve 6. The surface texture of housing 4, swivel clip 16, and sleeve 6 can be varied from smooth to any surface texture providing a desired level of decoration or grip enhancement. The high friction material 18 on the distal end of swivel clip 16 would preferable be made from rubber, silicone, or latex, although not limited thereto, and could be larger or smaller in dimension than that is shown in FIG. 1, as long as the substance used for high friction material 18 is durable so that it maintains its integrity during repeated use and functions as intended to secure housing 4 relative to a pocket, divider, or other surface or object. Cushioning material 88 could also be made from rubber, silicone, or latex, in addition to any other soft material, such as but not limited to soft gels and memory foam. Further, the shape and dimension of cushioning material 88 used can vary according to the decorative effect desired, as well as the level of comfort that is desired for a user's fingers and/or hand during extended use of the present invention. However, in many preferred embodiments the cushioning material 88 used would conform to the user's finger or thumb employed to hold sleeve 6 in its raised position during use of writing tip 12, such as but not limited to the triangular shape shown in FIG. 5 that is beveled inward with a slight curve to enhance grip. The decorative objects 58 attached to an activating mechanism used to raise sleeve 6, such as sliding mechanism 52 in FIG. 15, can also be optionally made from cushioning material 88 that is temporarily or permanently secured to the activating mechanism. Cushioning material 88 formed and colored to resemble decorative objects 58 can include the shape of the baseball or tennis ball shown in FIG. 6, and although not shown and not limited thereto, alternative configurations for decorative object 58 can include a basketball, football, animal, animal head, food item, flag, sports team logo, children's character, or school mascot. Roll ball 54 can also be optionally made from cushioning material 88, and can be configured as a wide variety of the objects, such as but not limited to any round sports ball, or a football. However, it should be appreciated that some shapes usable for decorative object 58 would not be possible for roll ball 54 due to its requirement for unrestricted rotating movement. It is preferred that all buttons 60, levers 50, push bars 48, roll balls 54, and sliding mechanisms 52 used in the present invention as activating mechanisms either have cushioning material 88 secured to it, under it, or both, to provide sufficient user comfort for extended writing/marking use. Further, although not shown, advertising/information can also be added to housing 4, swivel clip 16, sleeve 6, roll ball 54, or the decorative object 58 temporarily or permanently positioned upon the distal end of depressible button 60. The materials used for flexible lifting rod 36 can include metal, nylon, or thin plastic, while the materials contemplated for pivoting bar 62 and decorative object 58 can include but are not limited to plastic, stainless steel, and other metals, with the same soft materials used for cushioning material 88 also contemplated for decorative object 58. Braces 26 would typically be made from the same materials used for sleeve 6, such as but not limited to metal or plastic. In addition, although not shown, lifting rod 36 can be angled within any sleeve 6 around marking material cartridge 8 or have a forked configuration that bypasses cartridge 8 and would result in more than one attachment point to the interior upper surface of sleeve 6. Further, protrusions 94 could be applied for grip enhancement to any activating mechanism used to raise sleeve 6 that is positioned externally from housing 4, such as but not limited to sliding mechanism 52 and lever 50, or the cushioning material 88 secured thereto, or to any cushioning material 88 secured directly to housing 4. When sliding mechanism 52 and lever 50 are made from plastic, it is contemplated that protrusions 94 therein would be formed at the time of manufacture as a result of molded construction.

Although it is preferred for engagement of sleeve 6 around writing tip 12 to be automatic and accomplished immediately after each use of writing tip 12 or 66 is completed, manual engagement of sleeve 6 into its protective position is also considered to be within the scope of the present invention. To use any automatic embodiment of the present invention, one would pick up housing 4 with sleeve 6 in its lowered and protective position around writing/marking tip 12 or 66. Using light finger pressure typically from an index finger or thumb (not shown), the user would apply a force to the activating mechanism that mechanically or via battery power raises sleeve 6 or causes a hidden component to raise sleeve 6. For most preferred embodiments, light finger pressure would continue as long as writing/marking tip 12 or 66 is being used, with user comfort being enhanced by cushioning material 88. Then, once use of writing/marking tip 12 or 66 is completed, release of the activating mechanism causes the biasing means (spring 56 or other) to force sleeve 6 into its protective position over writing tip 12. The amount of distance through which sleeve 6 moves is small, typically being only one-fourth to three-eighths of an inch. For manual return of sleeve 6 into its lowered position around writing/marking tip 12 or 66, a user would have to reverse the amount and direction of force applied to the activating mechanism to raise sleeve 6. Although not shown, it is considered within the scope of the present invention for the mechanical movement of sleeve 6 to also cause a child's character, animal, other figure, flag, company logo, or more than one object, to pop up in a window in housing 4 and/or extend temporarily beyond housing 4, until sleeve 6 is again returned to its lowered and protective position around writing/marking tip 12 or 66. The pop-up movement could also be battery-assisted. Further, audio, vibration, or lights could accompany the pop-up movement to announce it, or otherwise entertain its user. Housing 4 could also be made from transparent material so that a user can view the mechanical action within that is employed to raise and lower sleeve 6 and/or the pop-up type of character or other movement previously described.

I claim:

1. A writing implement comprising:

a housing having an opening and a hollow interior;

a writing tip and means adapted to provide said writing tip with an uninterrupted flow of marking material, with said marking material means at least substantially positioned within said housing;

a sleeve having a smaller end with an opening therethrough that is slightly larger in diameter than said writing tip, said sleeve being partially positioned through said opening in said housing so as to be movable between a raised position wherein said writing tip extends through and beyond said opening in said smaller end of said sleeve and a lowered position wherein said writing tip is covered by said sleeve;

lifting means connected to said sleeve adapted for moving said sleeve into said raised position;

lowering means adapted for movement of said sleeve into said lowered position;

engagement means exposed through said housing and adapted for activation of said lifting means;

locking means adapted for preventing said sleeve from being inadvertently raised from its lowered and protective position around said writing tip until deliberately released; and stop means adapted to define the limits of movement of said sleeve between said raised position and said lowered and protective position whereby when light finger pressure is applied to said engagement means, said sleeve is temporarily raised for use of said writing tip for writing, marking, highlighting, and coloring purposes, and when use of said writing tip is concluded, cessation of the light finger pressure causes said lowering means to promptly move said sleeve into said lowered position around said writing tip where it is unavailable for further marking use until said sleeve is again raised by successively applied light finger pressure.

2. The writing implement of claim 1 wherein said sleeve further comprises centrally directed brace means configured to stabilize said writing tip.

3. The writing implement of claim 1 wherein said lifting means is selected from a group consisting of lifting rods, lifting bars, extensions, bars, pivoting bars, and pivoting extensions.

4. The writing implement of claim 1 wherein said sleeve has an upper end configuration adapted for engagement with said stop means.

5. The writing implement of claim 4 wherein said upper end configuration is selected from a group consisting of flared upper ends and flanges.

6. The writing implement of claim 1 wherein said lowering means comprises a compressible spring with an uncompressed length that is positioned between said sleeve and a stop disk located at a spaced-apart distance from said sleeve, with said spaced-apart distance being shorter than said uncompressed length of said spring.

7. The writing implement of claim 1 wherein said engagement means is selected from a group consisting of roll balls, levers, push bars, sliding mechanisms, and depressible buttons.

8. The writing implement of claim 1 wherein said locking means is selected from a group consisting of openings, keyhole-shaped openings, and depressions, and protrusions configured for engagement with said openings, keyhole-shaped openings, and depressions.

9. The writing implement of claim 1 wherein said stop means inwardly depends from said housing and is selected from a group consisting of blocks, ridges, bars, and protrusions.

10. The writing implement of claim 1 wherein said writing tip is configured for use with easily evaporated marking materials and further comprising insert means adapted for closing said opening in said smaller end of said sleeve so as to reduce marking material evaporation and drying out of said writing tip.

11. The writing implement of claim 1 wherein said lowering means is selected from a group consisting of automatic lowering means adapted for activation by release of light finger pressure and manual lowering means.

12. The writing implement of claim 1 further comprising a swivel clip attached to said housing in a position remote from said opening, said swivel clip being movable between an open position and a closed position.

13. The writing implement of claim 12 wherein said swivel clip has a distal end, and further comprising high-friction material attached to said distal end.

14. The writing implement of claim 1 further comprising cushioning material associated with said engagement means, said cushioning material being configured and dimensioned for enhancing the comfort of fingers and thumbs used to apply light pressure to said engagement means.

15. The writing implement of claim 1 further comprising cushioning material associated with said housing, said cushioning material being configured and dimensioned for enhancing the comfort of fingers and thumbs used to hold said housing and also those fingers and thumbs used to apply light pressure to said engagement means.

16. The writing implement of claim 1 further comprising decorative objects attached to said engagement means.

17. The writing implement of claim 16 wherein said decorative objects are made from cushioning material, said cushioning material being configured and dimensioned for enhancing the comfort of fingers and thumbs used to apply light pressure to said engagement means.

18. The writing implement of claim 16 wherein said decorative objects are selected from a group consisting of decorative objects permanently attached to said engagement means and decorative objects removably attached to said engagement means.

19. A method for manufacturing a writing implement with a writing tip and moveable sleeve that protects said writing tip when it is not being used for marking, said method comprising the steps of:

providing a housing having an opening and stopping means, a writing tip and means adapted to provide said writing tip with an uninterrupted flow of marking material, a sleeve having a smaller end with a small opening therethrough that is slightly larger in diameter than said writing tip, sleeve lifting means, sleeve lowering means, engagement means, and locking means;

positioning said marking material means at least substantially within said housing with said writing tip extending through said opening;

attaching any portion of said sleeve lifting means to said sleeve that requires attachment prior to insertion of said sleeve within said housing, and attaching each said portion of said sleeve lifting means to said sleeve in a manner that allows said sleeve lifting means to raise said sleeve a sufficient amount to reveal said writing tip through said small opening in said sleeve;

attaching any portion of said sleeve lowering means to said sleeve that requires attachment prior to insertion of said sleeve within said housing, and attaching each said portion of said sleeve lowering means to said sleeve in a manner that allows said sleeve lowering means to lower said sleeve around said writing tip to cover it;

partially positioning said sleeve within said opening of said housing so that said writing tip is oriented for movement through said small opening in said sleeve and also so that said stopping means within said housing is positioned relative to said sleeve to define a raised position for said sleeve wherein said writing tip extends through and beyond said small opening and also define a lowered position for said sleeve wherein said writing tip is covered by;

connecting any remaining portions of said sleeve lifting means and said sleeve lowering means to said sleeve so that said sleeve is movable between said raised position and said lowered position;

connecting said engagement means through said housing to said sleeve lifting means; and placing said locking means between said sleeve and said housing in a position that prevents said sleeve from being inadvertently raised from said lowered position around said writing tip until deliberately released so that light pressure from a finger applied to said engagement means causes sleeve lifting means to temporarily raise said sleeve for use of said writing tip for writing, marking, highlighting, and coloring purposes, and when use of said writing tip is concluded, cessation of the light finger pressure causes said sleeve lowering means to promptly move said sleeve into said lowered position around said writing tip to make said writing tip unavailable for further writing and marking use until said sleeve is again raised by successively applied light finger pressure.

20. The method of claim 19 further comprising the step of also connecting said engagement means through said housing to said sleeve lowering means so that finger pressure applied to said engagement means can alternatively raise and lower said sleeve.

* * * * *